United States Patent [19]

Koos, Jr.

[11] Patent Number: 4,515,292

[45] Date of Patent: May 7, 1985

[54] DIGITAL IMPLEMENTATION OF TONER CONCENTRATION SENSING APPARATUS

[75] Inventor: William M. Koos, Jr., Orlando, Fla.

[73] Assignee: Burroughs Corporation, Detroit, Mich.

[21] Appl. No.: 496,156

[22] Filed: May 19, 1983

[51] Int. Cl.[3] ..... B67D 5/14

[52] U.S. Cl. ..... 222/52; 222/DIG. 1; 222/57; 118/689

[58] Field of Search ..... 222/DIG. 1, 57, 52, 222/55, 56; 194/100 A; 118/689; 324/60 R, 57 Q, 55

[56] References Cited

U.S. PATENT DOCUMENTS

| | | | |
|---|---|---|---|
| 3,966,034 | 6/1976 | Heinman et al. | 194/100 A |
| 3,999,687 | 12/1976 | Baer et al. | 222/DIG. 1 |
| 4,195,260 | 3/1980 | Sakamoto et al. | 222/DIG. 1 |
| 4,380,309 | 4/1983 | Takahashi | 222/DIG. 1 |

OTHER PUBLICATIONS

Millman, Jacob and Halkias, Christos C., *Integrated Electronics: Analog and Digital Circuits and Systems*, 1972, McGraw-Hill Book Company, p. 569.

*Primary Examiner*—Joseph J. Rolla
*Assistant Examiner*—Andrew Jones
*Attorney, Agent, or Firm*—Mark T. Starr; Edmund M. Chung; Kevin R. Peterson

[57] ABSTRACT

A toner concentration sensor senses the concentration of toner in the toner system of an electro-photographic printer or copier. A novel circuit improves the toner concentration sensor. The novel circuit is composed of a resonant circuit, a frequency source, and a logic circuit. The resonant circuit is tuned to a selected frequency and has an inductor which creates a field into which the toner system is introduced. A frequency source excites the resonant circuit. A logic circuit receives a signal from the frequency source and an output from the resonant circuit. The logic circuit output is a signal representative of the phase shift between the signal from the frequency source and the output of the resonant circuit. The phase shift is representative of the inductance of the inductor in the presence of said toner system. The measurement of the inductance is representative of the concentration of toner in said toner system.

20 Claims, 4 Drawing Figures

DIGITAL IMPLEMENTATION OF TONER CONCENTRATION SENSING APPARATUS

BACKGROUND OF THE INVENTION

1. Field of the Invention

The present invention relates to apparatus for controlling the concentration of toner in the toner system of an electro-photographic apparatus. More specifically, the invention relates to a toner concentration sensor circuit for the apparatus.

2. Background of the Invention

Many prior art devices and apparatus have been employed in the past for detecting toner concentration so as to maintain the resulting copy uniform as to density and definition.

In one arrangement a pair of opposing glass plates provided with facing metallized surface is arranged so that toner passes between the plates which are electrically charged. The charge causes the toner to be attracted to the plates. An optical sensor, causes light to pass through the plates, the amount of toner being sensed is proportional to the amount of light received by the sensor-receptor. The sensitivity of this type of device is fairly low however, and detection is performed on the fly, i.e. as the toner is passing between the plates.

Still another apparatus employs "white" carrier beads with an optical sensor. The amount of "white" light reflected to the receptor varies with the amount of toner thereby enabling a determination to be made as to the concentration of the toner in the apparatus.

Each of the known types of toner concentration sensing devices is useful but no single device provides complete adequate and efficient signal output to prevent deterioration of the output copy. Thus, none of the prior art apparatus is capable of performing completely efficiently and adequately to provide copy whose density, definition and clarity remains constant throughout its period of use.

In order to maintain the optical density of the output copy constant in a high output device it is necessary to control the toner concentration in the printer or copier. High volume printer/copiers must operate more or less continuously and substantially unattended and therefore require some means for automatic control of the toner concentration. Many low volume copiers do not require automatic density control since the number of copies per day is sufficiently small that toner can be added manually by the operator as needed.

In application Ser. No. 429,861 "Toner Concentration Sensor for Electro-Photographic Apparatus" to Richard C. Fedder, filed Sept. 30, 1982, issued as U.S. Pat. No. 4,452,174 on June 5, 1984 assigned to the assignee, hereby incorporated by reference, apparatus was described which provided a simple, low cost, efficient and reliable means for controlling the toner concentration so as to provide a clean, clear, crisp, uniformly dense output copy. The basis for this apparatus is that studies have shown that the permeability of the developer mix changes with toner concentration with a higher permeability at lower toner concentration. This effect results from use of a two component developer (i.e. toner system) comprising a mixture of magnetic ferrite or steel carrier beads together with nonmagnetic toner particles. It is well known in the art of electrophotography that the toner particles and carrier beads take on the opposite sign of triboelectric charge when the mix is mechanically agitated. For example, the toner particles may become charged negatively due to rubbing against the carrier beads while the carrier beads become positively charged.

After a certain amount of mixing each carrier bead has many of the smaller negatively charged toner particles clinging to the surface of the bead. This coating of toner particles keeps the carrier beads slightly separated in the mix. With fewer toner particles on each carrier bead, the beads can come into closer proximity. In the extreme case when the toner concentration is zero, the carrier beads will come into direct contact with each other.

A variation in permeability is associated with the variation and separation of the carrier beads. Thus, when no toner is present while in a magnetic field, the carrier beads will hang together in a chain with no toner particles therebetween. The permeability along such a chain will be relatively high. Conversely, when toner particles are introduced into the mix the carrier beads will be separated somewhat by the toner particles. Thus, the permeability of the chain will be lower because of the intervening toner particles.

Ser. No. 429,861 takes advantage of the foregoing phenomenon to solve some of the problems associated with toner sensing. A modular, demountable, toner concentration sensor assembly is provided wherein a toner cartridge carrying a fresh supply of toner material is demountably insertable into the assembly so as to bring the fresh toner into the original developer mix and wherein a portion of developer mix is metered off the magnetic brush or application roller of the apparatus into an inductor surrounding a chute-like, open ended canister. An electromagnet is used to close the chute by immobilizing the developer mix within the chute while a signal output is taken from the inductance and applied to a sensing circuit to determine the quantity of toner to stabilize the mix concentration or bring the concentration to a predetermined level for copy printing output. An interconnected mechanism operably associated with the toner cartridge replenishes the toner on command from the system software as a result of a comparison between toner concentration levels and a selected concentration required for clear, clean, crisp printing/-copying.

SUMMARY OF THE INVENTION

The present invention is a novel circuit which improves the toner concentration sensor. The novel circuit has a digital frequency source for producing a high frequency square wave. The frequency is divided in a divider and provided to a resonant circuit having an inductor. The inductor creates a field into which the toner system is introduced. The inductor creates a phase shifted sine wave with the amount of phase shift related to the concentration of toner in the toner system. The sine wave is converted back to a square wave in a zero crossing detector. The output is fed to a logic circuit which also receives the output from the frequency divider. The phase shift between the square waves of the frequency source and zero crossing detector is determined. This phase shift is representative of the inductance of the inductor in the presence of the toner system. The measurement of the inductance is representative of the concentration of toner in the toner system. The resonant circuit will be tuned to give a 90° phase shift for a selected toner concentration. As the toner concentration varies, the inductance and phase shift will vary.

The output of the logic circuit is then fed to a counter which provides a numerical measurement of the phase shift. The counter receives the signal from the frequency source which acts as a clock to provide a numerical count of the phase shift. The output of the counter is fed to a comparator which also receives a toner concentration reference signal. The toner concentration reference signal indicates a selected level of toner concentration. By comparing the output of the counter with the reference signal a determination may be made as to whether toner must be added to the toner system. A control signal is provided from the comparator to apparatus to replenish toner.

DETAILED DESCRIPTION OF THE PREFERRED EMBODIMENT

Figure 1:
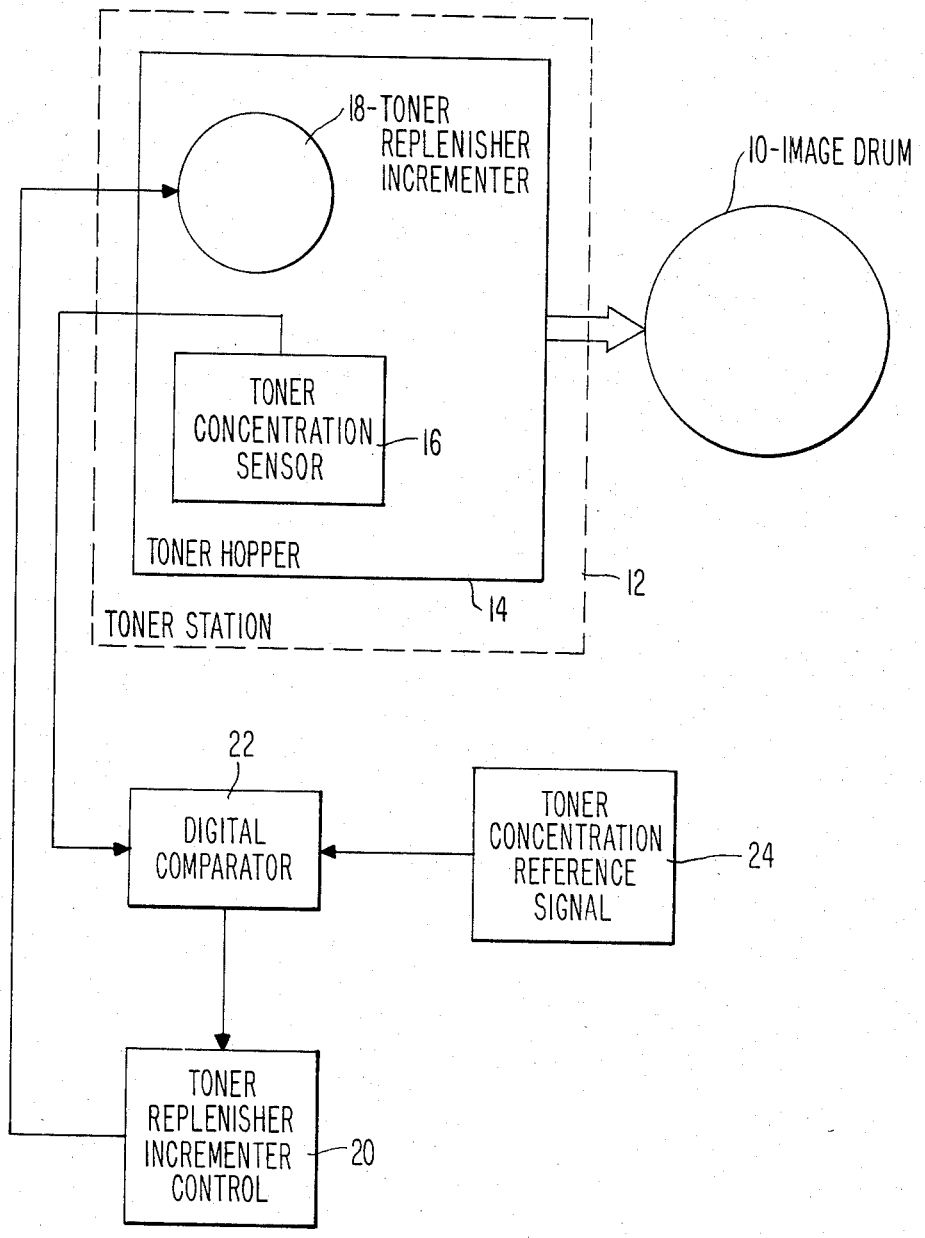
FIG. 1 is a block diagram of a system for measuring and correcting toner concentration in a printer.
Figure 2A:
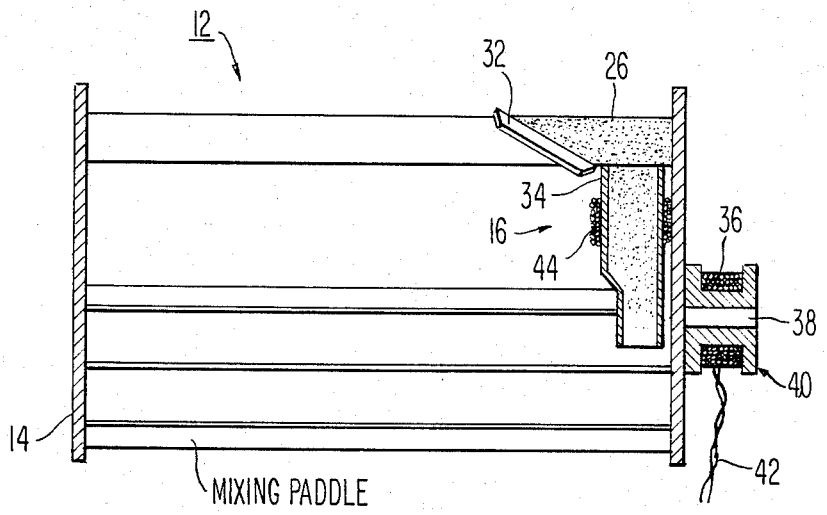
FIG. 2A is a front plan view of the toner station of FIG. 1.
Figure 2B:
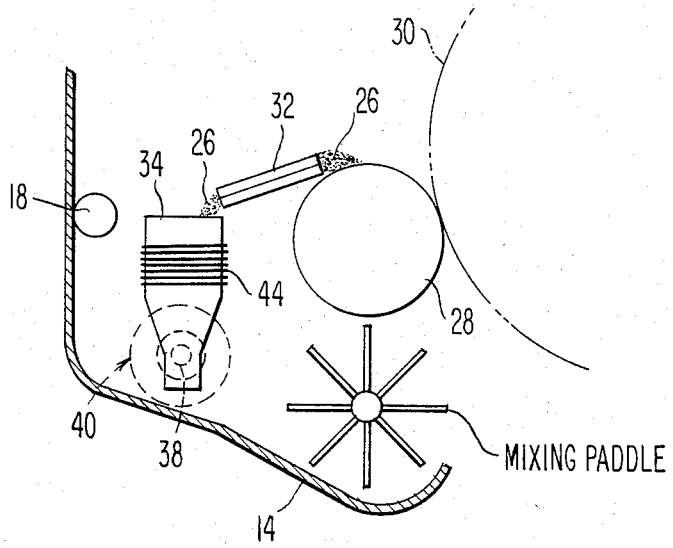
FIG. 2B is a side plan view of the toner station of FIG. 1.

FIG. 1 is a block diagram of a system for measuring and controlling the concentration of toner in a toner system in an electro-photographic type printer. The printer may be for example, electrostatic or xerographic. An image drum 10 will have electrostatic charges on its surface. The electrostatic charges form images to be printed. Toner is transfered from toner station 12 to the electrostatically charged images on drum 10. Toner station 12 is composed of a toner hopper 14, a toner concentration sensor 16 and a toner replenisher-incrementer 18. The details of toner station 12 are shown in FIG. 2. The toner hopper 14 holds the toner system. The toner system is made up of a toner and a developer. The toner for example, may be a Styene copolymer. The developer is composed of magnetic ferrite or steel carrier beads around which the nonmagnetic toner particles adhere. The toner concentration sensor 16 senses the concentration of toner in the toner system and provides an output which indicates the toner concentration. The details of the toner concentration sensor are provided in FIGS. 2, 3. Toner replenisher-incrementer 18 may be a dump cartridge. The dump cartridge holds toner and will release toner into the toner hopper 14 in a controlled manner. Control over toner replenisher-incrementer 18 is provided by toner replenisher-incrementer control 20 which may be a solenoid. The present invention relates to the toner concentration sensor 16 and the circuitry involved with it. The remainder of the components of the toner station 12, image drum 10 and mechanical details of toner concentration sensor 16 are the subject of application Ser. No. 429,861 referenced hereinbefore.

The concentration of toner in the toner system is very important to the print quality of the printer. It is necessary that the concentration be monitored and corrected. The process for measuring the concentration begins with the toner concentration sensor 16 which provides a relative measurement of toner concentration. The output of toner concentration 16 is fed to a comparator 22. The comparator also receives a toner concentration reference signal 24. The toner concentration reference signal may be established by making empirical measurements of an ideal toner system concentration in a sensor similar to toner concentration sensor 16. The toner concentration reference signal 24 may also be a concentration selected specifically to obtain lighter or darker settings on the copier. In comparator 22 the toner concentration reference signal is compared with the measured toner concentration from 16. The difference shown by the comparator will indicate whether toner must be added to the toner system to keep the selected concentration. The output of the digital comparator is fed to the toner replenisher-incrementer control 20 to allow a controlled amount of toner to be fed from toner replenisher-incrementer 18 into toner hopper 14.

FIG. 2 illustrates the toner concentration sensor 16 of the present invention operably associated with toner station 12. As shown, used toner system mix 26 coming off the top of the magnetic brush 28 after toning photoreceptor drum 30 is scraped off the magnetic brush roller 28 by a doctor blade 32 into a toner-sensor chute 34 of the toner concentration sensor 16.

Energization of a valve coil 36 surrounding the core 38 of capture solenoid 40 (over leads 42) causes a magnetic field to be developed near the tip of the coil core 38 which immobilizes the incoming toner system, momentarily compacting it within the chute and preventing any toner system flow-through. The valve coil 36 and core 38 make up capture solenoid 40. Once the toner system 26 has filled the chute 34, a toner sensor coil 44 surrounding the upper portion of the chute 34 is energized over lines (not shown) from a sensing circuit (not shown). The inductance of the toner sensor coil 44 now depends upon the permeability of the developer in toner system 26 and hence of the toner concentration in the toner system 26. After the measurement has been made the valve coil 36 is de-energized whereupon the toner system 26 drops or falls into the toner hopper 14 for reuse. Obviously, the level of developer in the toner hopper 14 must be sufficiently low relative to the chute bottom to ensure free flow of the developer out of the bottom of the chute 34.

Figure 3:
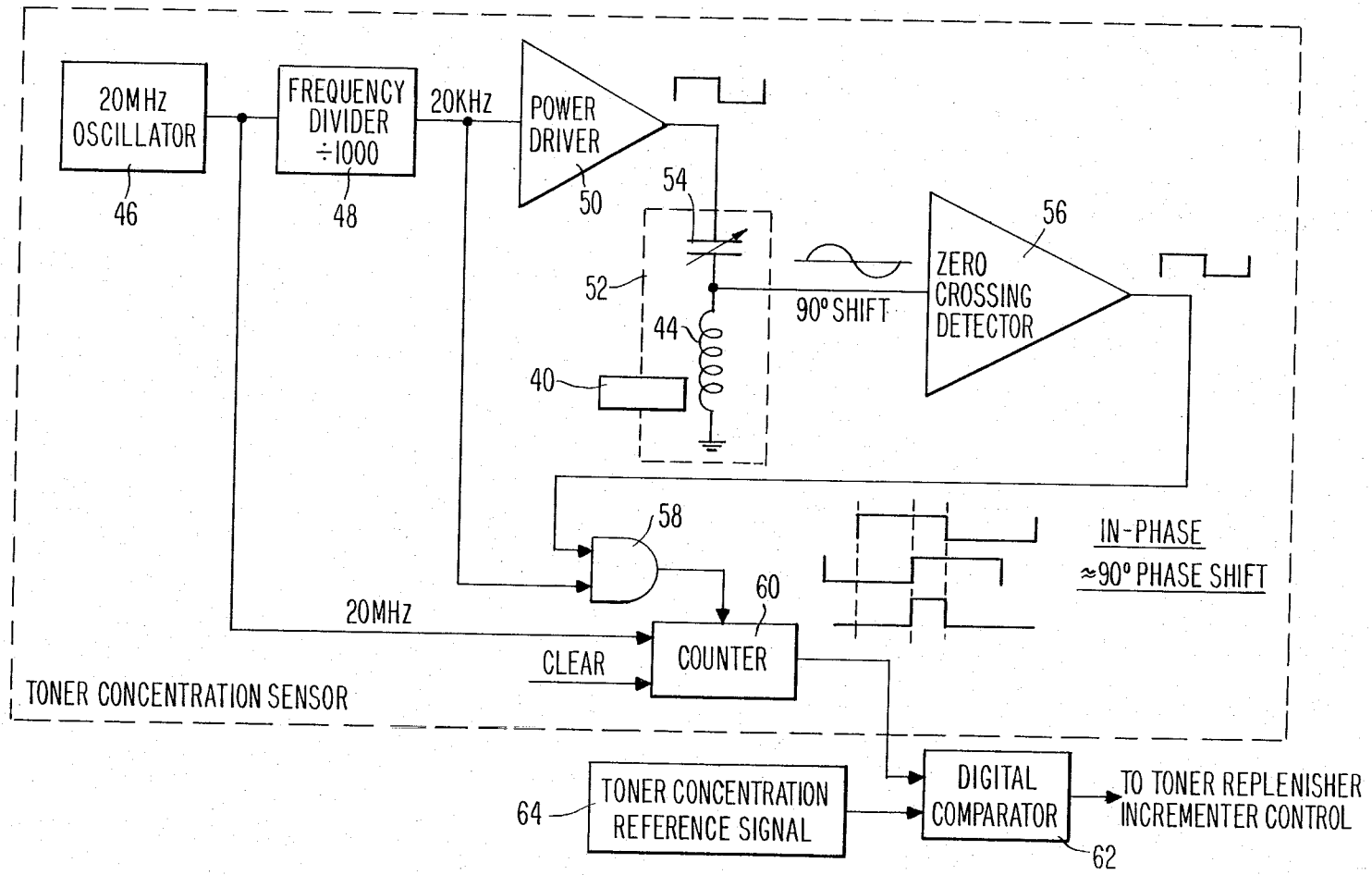
FIG. 3 is a block diagram of the toner concentration sensor circuit for the toner concentration sensor shown in FIGS. 1, 2.

FIG. 3 is a detailed block diagram of the novel circuitry of the toner concentration sensor of FIGS. 1 and 2. A 20-MHz oscillator 46 provides a digital square wave signal to frequency divider 48 which divides the frequency by a factor of one thousand. Other frequencies and divider ratios are possible. A 20-KHz square wave signal is produced. This signal is provided to a power driver 50 which increases the amplitude of the square wave. The phase of the signal at this point, however, is unchanged. The output of power driver 50 is provided to a resonant circuit 52 which includes a variable capacitor 54 and inductor 44. Resonant circuit 52 is an RLC circuit. The capacitance is provided by capacitor 54, the inductance by inductor 44 and the resistance by the inherent resistance of inductor 44. Typical values for the variable capacitor 54 and inductor 44 would be 2000 pf and 13 mH (with no toner mix) respectively. The value of the inductor is dependent on the excitation frequency and inherent resistance of the inductor 44, along with the permeability of the toner mix. RLC circuit 52 is tuned to a 20-KHz signal. The tuning is done with the toner system inside inductor 44. The capture solenoid 40 is located adjacent to the bottom end of inductor 44. Capture solenoid 40, as previously described, creates a field across the bottom of inductor 44 which causes the toner system in inductor 44 to clog up the bottom and hence fill inductor 44. When the inductor 44 is filled, the measurement of the inductance is taken.

The square wave input to resonant circuit 52 will be a phase shifted and converted to a sine wave output. It should be noted that almost any signal put into the resonant RLC circuit will create a sine wave. The sine wave is shifted approximately 90°. The exact shift will depend on the concentration of the toner in the toner system in inductor 44. The sine wave output of resonant circuit 52 is provided to a zero crossing detector 56 which converts the sine wave into a square wave again. In other words, the signal is shifted from an analog sine wave signal into a digital square wave signal. The zero crossing detector measures the points at which the sine wave crosses the axis and constructs the square wave from this information. The output of zero crossing detector 40 is provided to logic circuit 58. The latter logic circuit also receives a sample of the 20-KHz square wave which was provided to the input of the resonant circuit 52 through power driver 50. Logic circuit 58 is an AND gate which compares the two waveforms.

The three waveforms drawn next to logic circuit 58 illustrate what happens when a comparison is made of the two signals in logic circuit 58. The top square wave shows the 20-KHz signal coming from frequency divider 48. The middle signal shows the phase shifted square wave signal coming from zero crossing detector 56. This signal is shifted approximately 90°. The actual phase shift will depend on the concentration of the toner in the toner system in inductor 44. The bottom waveform is representative of the amount of phase shift between the 20-KHz oscillation signal and the inductively shifted signal. The output of logic circuit 58 is provided to digital counter 60. Digital counter 60 will provide a numerical count representative of the phase shift illustrated by the input waveform. The 20-MHz signal from oscillator 46 provides the clock which counts the amount of phase shift. The 20-MHz clock will provide 256 counts for each half cycle of the 20-KHz frequency of the waveform from logic circuit 58. Because the phase shift will be approximately 90°, the number of counts of the phase shifted waveform will be approximately 128 with the count varying above or below 128, depending on the concentration of the toner.

The output of digital counter 60 represents a measure of the concentration of toner sensed in the circuit. This output is fed to digital comparator 62. The toner concentration reference signal is derived by empirical measurements of the inductance of an ideal concentration of toner in a toner system in a resonant circuit similar to resonant circuit 52. This reference signal is compared with the actual measured inductance value for the sample being measured in resonant circuit 52. The output of digital comparator 62 will indicate whether there is a shortage of toner in the toner system. If a shortage is indicated, a signal will be provided to toner replenisher-incrementer control 20.

In operation, before a printer is put on the market, empirical measurements will be made to determine the toner concentration reference signal 24. This will be done by using an ideal concentration of toner in a toner system which will be placed in the inductor of a resonant circuit identical to that shown as 52 in FIG. 2. The inductance value measured will be the toner concentration reference signal. This will represent the inductance for an ideal concentration of toner in the toner system.

After the toner concentration reference signal is established, the remainder of the circuit is ready to be utilized. Imaging drum 10 is constantly using toner system from toner system hopper 14. The developer with the adhering toner (i.e. toner system) is constantly being fed onto image drum 10. The developer beads are returned to toner hopper 14. However, toner remains on the image drum. After a period of time, the toner concentration for the toner system in hopper 14 begins to decrease. The toner sensor is designed to sense this deviation of the toner concentration away from the ideal toner concentration.

The measurement process begins when the toner capture solenoid 40 is energized. This sets up a magnetic field across the bottom of inductor 44. The steel beads of the developer clog at the bottom of the inductor and cause the entire inductor to fill with the toner system. At this point, the inductance measurement is ready to be taken. The circuit of the toner concentration sensor is now activated. Oscillator 26 produces a 20-MHz digital square wave. The signal is divided to 20-KHz in frequency divider 48. The 20-KHz signal is amplified in power driver 50 and is applied to resonant circuit 52. A sine wave, shifted by approximately 90°, will be the output of resonant circuit 52. The inductance of resonant circuit 52 will increase as the toner concentration of the toner system is decreased. This results because the steel beads of the developer are more concentrated in the inductor. Thus in effect making a more continuous metallic core to the inductor. Thus, the inductance will vary depending on the amount of developer in resonant circuit 52. The phase shifted sine wave is converted to a square wave in zero crossing detector 56 and is applied to logic circuit 58. A 20-KHz signal from frequency divider 48 is also applied to logic circuit 58 to act as a reference against which to measure the phase shift of the measured inductance. As described previously, the output of logic circuit 58 gives a measurement of the change in inductance due to concentration of the toner in the toner system sampled. This representation of phase change is converted to a numerical representation in digital counter 60. A 20-MHz clock signal from oscillator 46 is used to give a numerical measurement of the amount of phase change. The inductance of the sampled toner system concentration is now measured against the toner concentration reference signal in digital comparator 62. This gives an indication as to whether the toner concentration is low. If the toner concentration is found to be low the signal is fed to the toner replenisher-incrementor control 20 which will cause toner replenisher-incrementor 18 to deposit a controlled amount of toner system into toner hopper 14.

What is claimed is:

1. An apparatus for monitoring the concentration of toner in a toner system, said apparatus comprising:

means for holding a supply of said toner system, said toner system including a mixture of toner particles and ferromagnetic carrier beads;

a resonant circuit tuned to a fixed predetermined frequency, said resonant circuit including a sensor coil surrounding a portion of said holding means;

means for exciting said resonant circuit with a first signal, said first signal's frequency being said fixed predetermined frequency; and logic circuit means, responsive to a second signal from said exciting means, said second signal's frequency also being said fixed predetermined frequency, said logic circuit means further being responsive to an output from said resonant circuit, said logic circuit means for generating at its output a signal representative of a phase shift between said second signal and the output from said resonant circuit, the amount of said phase shift indicative of the actual concentration of the toner in said toner system.

2. The apparatus in accordance with claim 1 wherein said exciting means applies a square wave digital signal to said resonant circuit and in response, said resonant circuit produces a phase shifted sine wave.

3. The apparatus in accordance with claim 1 further including:

counter means, responsive to a third signal from said exciting means, said third signal's frequency being a multiple of said first signal's frequency, said counter means further responsive to the output of said logic circuit means, for providing a numerical count representative of the phase shift between said second signal and the output from said resonant circuit;

reference means for providing a reference signal representative of the phase shift when said supply of toner system has a selected concentration of said toner; and comparator means, responsive to said counter means and said reference means, for indicating whether additional toner must be added to the toner system to restore the toner system to the selected concentration.

4. The apparatus in accordance with claim 3 wherein said exciting means includes:

a high frequency oscillator providing a square wave signal at its output;

a frequency divider receiving as its input the output of said oscillator, said divider providing at its output a divided square wave signal, the frequency of said divided square wave signal being the same as said fixed predetermined frequency; and a power driver receiving the output of said divider and providing as its output said first signal to said resonant circuit.

5. The apparatus in accordance with claim 4 wherein said resonant circuit further includes a capacitor, a first side of said capacitor receiving said first signal, the second side of said capacitor connected to a first end of said sensor coil, the second end of said sensor coil at ground, said logic circuit means receiving the output from the connection between said sensor coil and said capacitor.

6. The apparatus in accordance with claim 5 wherein said logic circuit means includes a zero crossing detector receiving the output of said resonant circuit, the output of said zero crossing detector providing one input to a logical AND gate, a second input to said logical AND gate provided by the output of said divider, said zero crossing detector for generating a square wave from the output of said resonant circuit, the output of said resonant circuit being sinusoidal.

7. The apparatus in accordance with claim 6 wherein said counter means is a digital counter, the clock input to said counter receiving the output of the high frequency oscillator, the count input to said counter receiving the output of said AND gate.

8. The apparatus in accordance with claim 1 wherein said exciting means includes:

a high frequency oscillator providing a square wave signal at its output;

a frequency divider receiving as its input the output of said oscillator, said divider providing at its output a divided square wave signal, the frequency of said divided square wave signal being the same as said fixed predetermined frequency; and a power driver receiving the output of said divider and providing as its output said first signal to said resonant circuit.

9. The apparatus in accordance with claim 1 wherein said resonant circuit further includes a capacitor, a first side of said capacitor receiving said first signal, the second side of said capacitor connected to a first end of said sensor coil, the second end of said sensor coil at ground, said logic circuit means receiving the output from the connection between said sensor coil and said capacitor.

10. The apparatus in accordance with claim 4 wherein said logic circuit means includes a zero crossing detector receiving the output of said resonant circuit, the output of said zero crossing detector providing one input to a logical AND gate, a second input to said logical AND gate provided by the output of said divider, said zero crossing detector for generating a square wave from the output of said resonant circuit, the output of said resonant circuit being sinusoidal.

11. The apparatus in accordance with claim 3 further including:

toner replenisher means for adding toner to said toner system; and control means, responsive to said comparator means, for controlling the amount of said toner that the toner replenisher means adds to said toner system.

12. The apparatus in accordance with claim 9 wherein:

said oscillator provides a 20-MHz square wave signal at its output;

said frequency divider divides the frequency of its input by a factor of one thousand;

the capacitor has a capacitance of approximately 2000 pf;

the sensor coil has an inductance of approximately 13 mH when the holding means is not filled with the toner system; and the resonant circuit is turned to a 20 KHz frequency.

13. An apparatus for monitoring the concentration of toner in a toner system, said apparatus comprising:

means for holding a supply of said toner system, said toner system including a mixture of toner particles and ferromagnetic carrier beads;

a resonant circuit tuned to a selected frequency, said resonant circuit including a sensor coil in a series connection with one lead of a capacitor, said sensor coil surrounding a portion of said holding means;

means for exciting said resonant circuit with a first signal, said first signal's frequency being said selected frequency, said first signal applied to the other lead unconnected end of said capacitor; and logic circuit means, coupled to the series connection of said resonant circuit and responsive to said exciting means, said logic circuit means for generating at its output a signal representative of a phase shift between said first signal and an output signal from said resonant circuit, the amount of said phase shift responsive to the actual concentration of the toner in said toner system.

14. The apparatus in accordance with claim 13 wherein the unconnected end of said sensor coil is grounded.

15. The apparatus in accordance with claim 13 further including:

counter means, responsive to said exciting means and said logic circuit means, for providing a numerical count representative of the phase shift between said first signal and the output of said resonant circuit;

reference means for providing a reference signal representative of the phase shift when said supply of toner system has a selected concentration of said toner; and comparator means, responsive to said counter means and said reference means, for indicating whether additional toner must be added to the toner system to restore the toner system to the selected concentration.

16. The apparatus in accordance with claim 15 wherein said exciting means includes:

a high frequency oscillator providing a square wave signal at its output;

a frequency divider receiving as its input the output of said oscillator, said divider providing at its output a divided square wave signal, the frequency of said divided square wave signal being the same as said selected frequency; and a power driver receiving the output of said divider and providing as its output said first signal to said resonant circuit.

17. The apparatus in accordance with claim 16 wherein said logic circuit means includes a zero crossing detector receiving the output of said resonant circuit, the output of said zero crossing detector providing one input to a logical AND gate, a second input to said logical AND gate provided by the output of said divider, said zero crossing detector for generating a square wave from the output of said resonant circuit, the output of said resonant circuit being sinusoidal.

18. The apparatus in accordance with claim 17 wherein said counter means is a digital counter, the clock input to said counter receiving the output of the high frequency oscillator, the count input to said counter receiving the output of said AND gate.

19. The apparatus in accordance with claim 15 further including:

toner replenisher means for adding toner to said toner system; and control means, responsive to said comparator means, for controlling the amount of said toner that the toner replenisher means adds to said toner system.

20. The apparatus in accordance with claim 18 wherein:

said oscillator provides a 20-MHz square wave signal at its output;

said frequency divider divides the frequency of its input by a factor of one thousand;

the capacitor has a capacitance of approximately 2000 pf;

The sensor coil has an inducatance of approximately 13 mH when the holding means is not filled with the toner system; and the resonant circuit is turned to a 20 KHz frequency.

* * * * *